United States Patent [19]

Hirose et al.

[11] Patent Number: 4,718,658

[45] Date of Patent: Jan. 12, 1988

[54] SHEET FEEDING SYSTEM USING DETACHABLE SHEET STORAGE UNIT IN IMAGE PROCESSING DEVICE

[75] Inventors: Toshihiko Hirose, Yamanashi; Tatsuhiko Neno, Kofu, both of Japan

[73] Assignee: Nippon Seimitsu Kogyo Kabushiki Kaisha, Kofu, Japan

[21] Appl. No.: 833,157

[22] Filed: Feb. 27, 1986

[51] Int. Cl.[4] ..... B65H 7/02; B65H 1/08

[52] U.S. Cl. ..... 271/258; 271/145; 271/147; 355/14 SH

[58] Field of Search ..... 271/162–164, 271/272–274, 289–290, 145, 258, 259, 110, 265, 9; 355/3 SH, 14 HS

[56] References Cited

U.S. PATENT DOCUMENTS

| | | | |
|---|---|---|---|
| 3,527,406 | 9/1970 | Snellman | 271/110 |
| 3,995,952 | 12/1976 | Schoppe | 355/3 SH |
| 4,433,905 | 2/1984 | Haramaki et al. | 355/14 SH |
| 4,534,643 | 8/1985 | Watanabe | 271/290 |
| 4,605,299 | 8/1986 | Mochimaru | 355/3 SH |

FOREIGN PATENT DOCUMENTS

| | | | |
|---|---|---|---|
| 1100538 | 5/1981 | Canada | 271/265 |
| 194021(A) | 11/1983 | Japan | 355/14 SH |
| 198234(A) | 11/1984 | Japan | 271/110 |
| 58-105585 | 1/1985 | Japan . | |
| 168161(A) | 8/1985 | Japan | 355/3 SH |

*Primary Examiner*—H. Grant Skaggs

*Attorney, Agent, or Firm*—Oblon, Fisher, Spivak, McClelland, & Maier

[57] ABSTRACT

A sheet feeding system for use in an image processing device composed of a desktop type image forming unit such as an electrostatic copying machine and a pedestal for permitting the image forming device to be placed thereon, which comprises a sheet storage unit having a vertically movable sheet tray on which a large number of sheets can be stacked. The united system body of the image forming unit and the pedestal defines a holder cavity for permitting the sheet storage unit to be put thereinto so as to enable the stacked sheets in the sheet storage unit to be sent out one by one.

3 Claims, 12 Drawing Figures

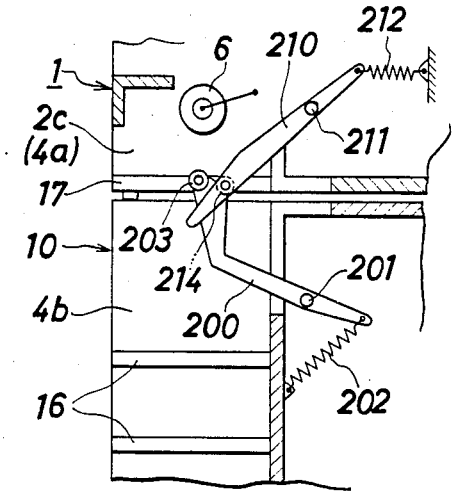
FIG_10(A)
FIG_10(C)
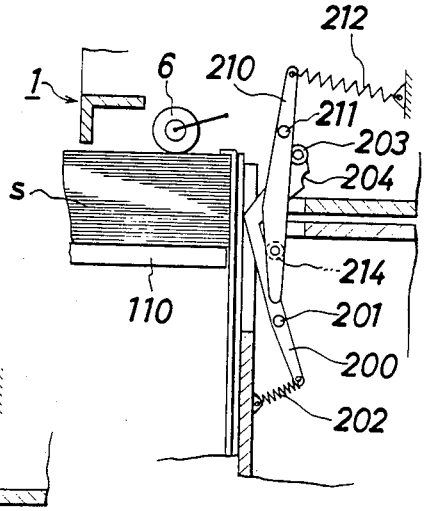
FIG_10(B)
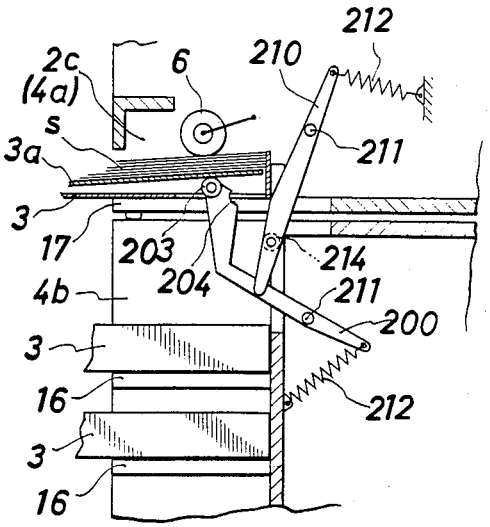

SHEET FEEDING SYSTEM USING DETACHABLE SHEET STORAGE UNIT IN IMAGE PROCESSING DEVICE

FIELD OF THE INVENTION

This invention relates to a sheet feeding system using a detachable sheet storage unit in an image processing device, and more particularly, to a sheet feeding system using a sheet storage unit capable of containing a large number of sheets and being detachably coupled to an image processing device including an image forming unit of small size such as an electrostatic copying machine.

DESCRIPTION OF THE PRIOR ART

Recently image processing devices such as electrostatic copying machines, various types of printers including liquid crystal shutter printers and laser printers, and press machines are being increasingly used. Among these systems there have been known the desktop type image processing device of small size which generally uses as one element of the sheet feeding system thereof a sheet cassette containing a relatively small number of sheets such as copying papers and printing papers. As is typically adopted in conventional copying machines, the sheet cassette of this type can generally accommodate sheets of the order of 500 at most and is fitted to the machine body so that the sheets contained therein can be continuously supplied to the machine body one by one.

However, when the sheets of a fixed size are used in great quantities, the sheet feeding system employing such a sheet cassette has entailed a disadvantage in that the sheets must be frequently loaded into the sheet cassette.

To improve this situation, there has been proposed a copying machine comprising, in one united body, a desktop type copying machine and a pedestal formed integrally with a sheet storage cavity in Japanese Patent Application Public Disclosure No. Sho 57-90330. The sheet storage cavity in the proposed copying machine is capable of containing a large number of copying papers. However, because it is impossible to remove the sheet storage cavity from the copying machine, the overall system of this copying machine cannot be reduced in size and weight, and it becomes difficult to undergo repair and maintenance. Owing to the problems issuing from the bulky structure of the system mentioned above, it has found utility in a limited range of applications.

There has been proposed another copying machine using a separated sheet container in Japanese Patent Application Public Disclosure No. Sho 59-78025, wherein the sheet container is attached to the outside of the machine body so as to enable the sheets contained in the sheet container to be fed one by one toward a photosensitive drum. In this copying machine, however, the sheet feeding distance from a sheet takeout port of the sheet container to the photosensitive drum, i.e. the sheet travel distance, is increased because the sheet container is set on the outside of the machine body. This means that the speed of the image processing operation is reduced and it is difficult to control the timing of sheet transfer, namely, synchronize an image forming mechanism with the sheet container, consequently to obstruct the desired increase in operation speed.

In the copying machine wherein the sheet container is attached to the outside thereof as one possible way for attaining the elevation of the operation speed, attempts are being made to accelerate the rotational speed of sheet feeding rollers mounted in the copying machine. Another approach has been to try to attain the increase in operational speed by use of two sheet sensors disposed en route to a sheet feeding path as proposed in the aforesaid Japanese Disclosure No. Sho 59-78025. The proposed sheet feeding system is so designed that while a sheet passes the front of the sensors, the subsequent sheet is fed to the rear sensor so as to assume its standby state in order to feed the sheets one by one at a high rate of speed. The sheet feeding system has suffered a disadvantage in that there is a limit in increasing the operational speed and the control system required for controlling the aforesaid sheet feeding system becomes complicated in structure and difficult to operate.

OBJECT AND SUMMARY OF THE INVENTION

In view of the aforementioned drawbacks of conventional sheet feeding systems for use in an image processing device such as a copying machine, it is object of the present invention to provide a sheet feeding system comprising a sheet storage unit for accommodating a large number of sheets, which can be detachably fitted into a system body with ease and attain an increase in the operational speed by reducing the sheet travel distance, and is easy to operation and handle.

Another object of the present invention is to provide an image processing system using a detachable sheet storage unit, in which sheets stacked in the sheet storage unit can be adequately positioned to a fixed level in accordance with the amount of the sheets which is precisely grasped by means of level detecting means.

The present invention attains the aforesaid objects by providing a sheet feeding system for use in an image processing device having an image forming unit and a pedestal for permitting the image forming unit to be put thereon, which comprises a sheet storage unit provided with a sheet tray capable of being stacked with a large number of sheets and an elevating drive means for moving up and down the sheet tray, the aforesaid image forming unit being provided in its lower side portion with a cavity half, the aforesaid pedestal being provided in its upper side portion with a cavity half for forming a holder cavity in conjunction with the cavity half of the image forming unit, the holder cavity being adapted to detachably receive the sheet storage unit.

Since the sheet storage unit can be fitted into the holder cavity defined by the united body of the image forming unit and pedestal, the sheet travel distance in the image forming unit can be shortened to thereby increase the speed of the image processing operation. The sheet storage unit is provided on the front and side walls thereof with coupling means capable of engagement with the counterparts provided on the image forming unit, whereby the sheet storage unit can steadily and easily fitted into and detached from the aforesaid united body.

On the image forming unit or the sheet storage unit there is provided with a sheet detecting means consisting of a sheet level sensor and a sheet empty sensor, thereby enabling the sheets contained in the sheet storage unit to be positioned at an adequate level for effectively sending out the sheets one by one.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 10(A) to 10(C) are explanatory views showing in side elevation the operating principle of a sheet push-up mechanism for a sheet cassette.

DESCRIPTION OF THE PREFERRED EMBODIMENTS

Figure 1:
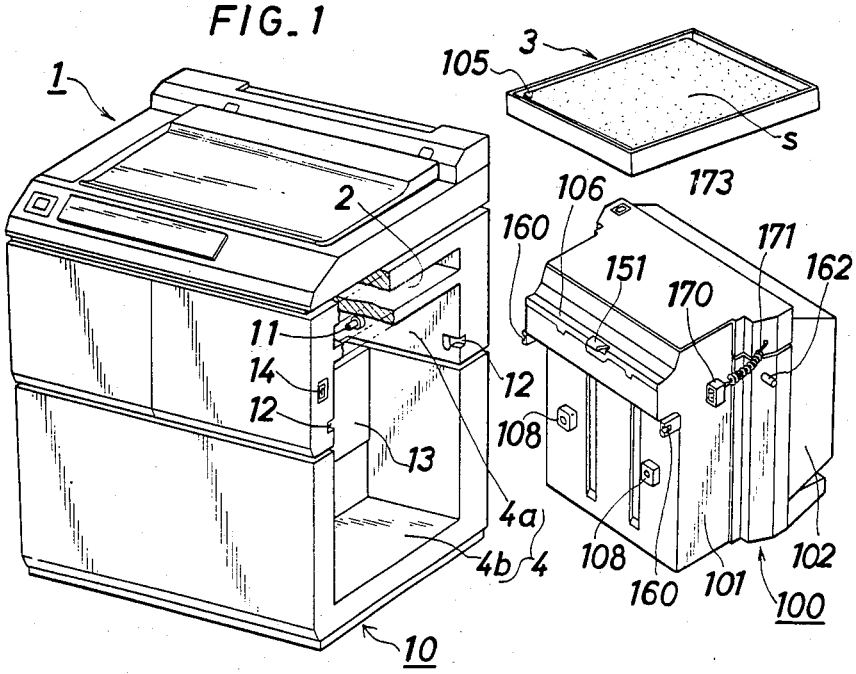
FIG. 1 is a partly broken away perspective view of an image processing device incorporating a sheet feeding system of one embodiment according to the present invention.
Figure 2:
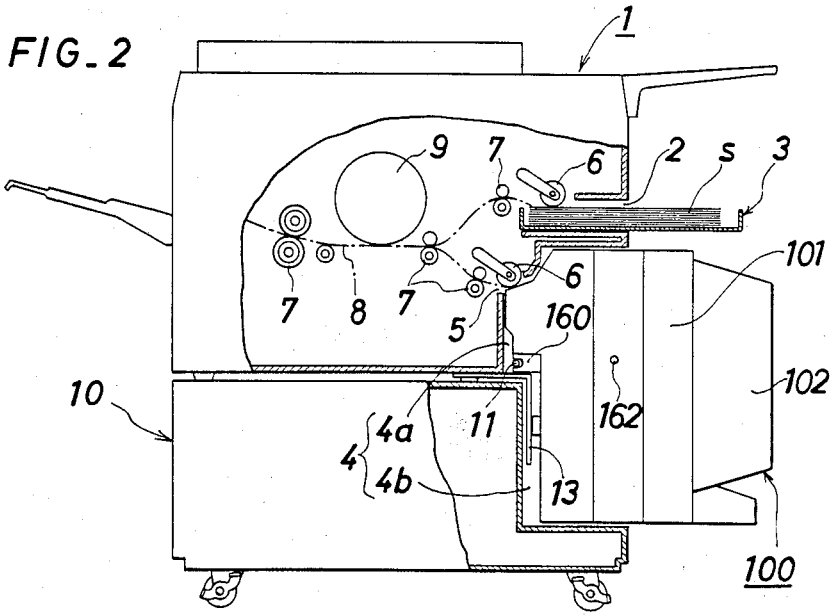
FIG. 2 is a partly broken away side view of the image processing device of FIG. 1.

The image processing device incorporating the sheet feeding system according to a first embodiment of this invention will be described with reference to the schematic diagrams of FIGS. 1 to 6.

In the drawings, the reference numeral 1 denotes an image forming unit of small size such as a desktop type electrostatic copying machine, printing machines of various types including laser printers, and liquid crystal shutter printers, and press machines. The typical image forming unit of this type is provided in one side portion thereof with one or more cassette holders 2 for receiving a sheet cassette 3 containing a relatively small number of sheets such as copying papers. During an image forming operation, the sheets contained in the sheet cassette 3 attached into the cassette holder 2 can be taken out and introduced into an image processing stage of the aforementioned image forming unit 1.

In the lower part of one side of the image forming unit 1, there is formed a cavity half 4*a* having a sheet intake port 5 formed in the innermost portion thereof. On the respective upper portions of the cassette holders, sheet delivery rollers 6 are disposed. One of the sheet delivery rollers 6 is disposed close by the sheet intake port 5. The image forming unit 1 illustrated in FIG. 2 as one example is in the form of an electrostatic copying machine in which a photosensitive drum 9 is disposed on the sheet feeding path 8 defined by a plurality of feed rollers 7 and so on. The elements including the feed rollers 7 constitutes one part of the sheet feeding system in this embodiment. Needless to say, in this invention, the kind and structure of the image forming unit are not specifically limited.

A pedestal 10 on which the image forming unit 1 is put is provided in the upper part of one side thereof with a cavity half 4*b* which forms a holder cavity 4 in conjunction with the cavity half 4*a* of the image forming unit 1. The space except for the cavity half 4*b* in the pedestal 10 can be utilized as a container. The system body of the image processing device is constituted by the united image forming unit 1 and pedestal 10.

A sheet storage unit 100 can be detachably fitted into the holder cavity 4 formed in the system body of the united image forming unit 1 and pedestal 10. The sheet storage unit 100 as one element of the sheet feeding system according to the invention is composed of a housing 101, a sheet tray 110 disposed movably up and down inside the housing 101 and capable of being stacked with a large number of sheets s, an elevating drive means 120 for vertically moving the sheet tray 110, and a sheet discharge means 130 for sending out the sheet of the stacked sheets s on the sheet tray 110.

The housing 101 has a rear lid 102 capable of opening outwardly so as to allow the sheets to be loaded into the sheet storage unit 100 and stacked on the sheet tray 110. There are formed a pair of supporting side walls 103 opposite to each other within the housing 101. Each supporting side wall 103 is provided in the substantially middle portion thereof with a vertical guide slit or recess 104.

Figure 3:
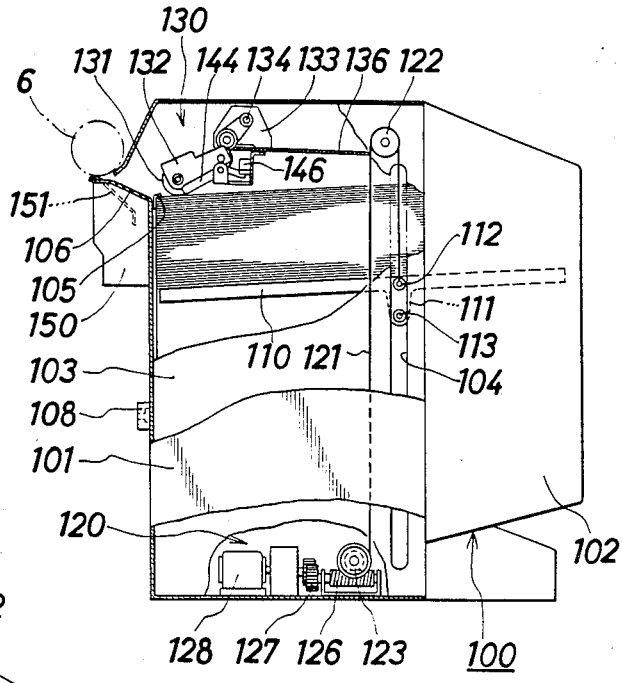
FIG. 3 is a sectioned side view of a sheet storage unit.
Figure 4:
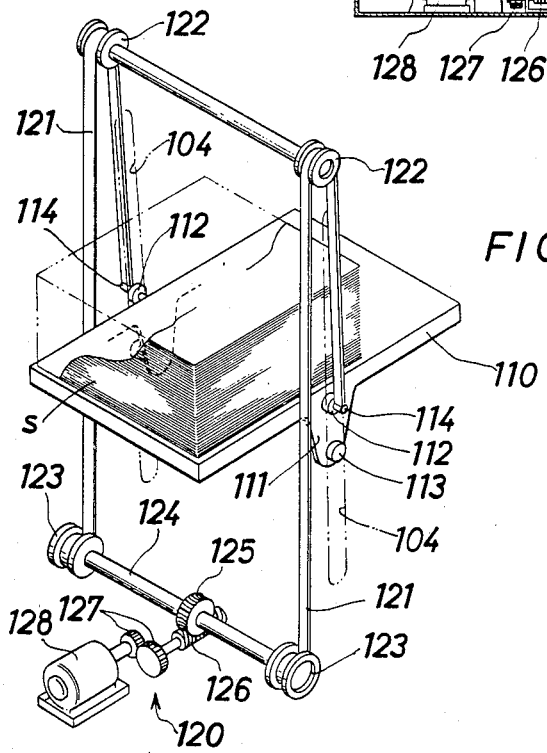
FIG. 4 is a perspective view schematically showing an elevating drive means for a sheet tray in the sheet storage unit.

The aforementioned sheet tray 110 has supporting arms 111 which extend downwardly from the opposite sides thereof and are respectively provided with a pair of guide rollers 112 and 113 vertically separated apart from each other as shown in FIGS. 3 and 4. The guide rollers 112 and 113 on the supporting arms 111 are in slidable engagement with the guide slits or recesses 104 formed in the opposite side walls 103 so as to permit the sheet tray 110 to undergo parallel movement in a vertical direction. In the illustrated embodiment, the axial shaft of each of the guide rollers 112 protrudes outwardly so as to form a hook member 114. However, such a hook member may be disposed anywhere on the sheet tray 110. The sheet tray 110 is connected to the elevating drive means 120 through the medium of a pair of hoisting members 121 such as wires, chains or belts. Each hoisting member 121 has one end coupled to the hook member 114 extending outwardly from either side of the sheet tray and is wound around a guide pulley 122 disposed pivotally on the side wall 103 en route from the elevating drive means 120 to the sheet tray 110.

The elevating drive means 120 is composed of a pair of winding drums 123 attached on the opposite ends of a driving shaft 124 supported rotatably between the side walls 103 and adapted to wind up the hoisting members 121, transmission means including a worm wheel 125, a worm gear 126 and gears 127, and a reversible motor 128 for rotating the winding drums 123 by use of the aforesaid transmission means. When the motor 128 is in motion, the hoisting members 121 are wound up around or rewound from the winding drums 123 so as to vertically move the sheet tray 110 with the guide rollers 112 and 113 being slidably guided by the guide slits or recesses 104 formed in the opposite side walls 103, so that the uppermost sheet of the stacked sheets s on the sheet tray 110 can readily be leveled to an adequate height by driving the motor 128, keeping the sheet tray 110 at a fixed angle. Besides, with the construction in which the sheet tray 110 is suspended by the paired hoisting members 121 such as belts, the sheet tray 110 can keep its posture in the suitable state without being affected by the weight of the stacked sheets and other factors and prevent thrust load from being generated on the driving shaft 124. This means that the driving means comprising the worm wheel 125, worm gear 126 and gears 127 enjoys stable working over a long period of time.

Figure 5:
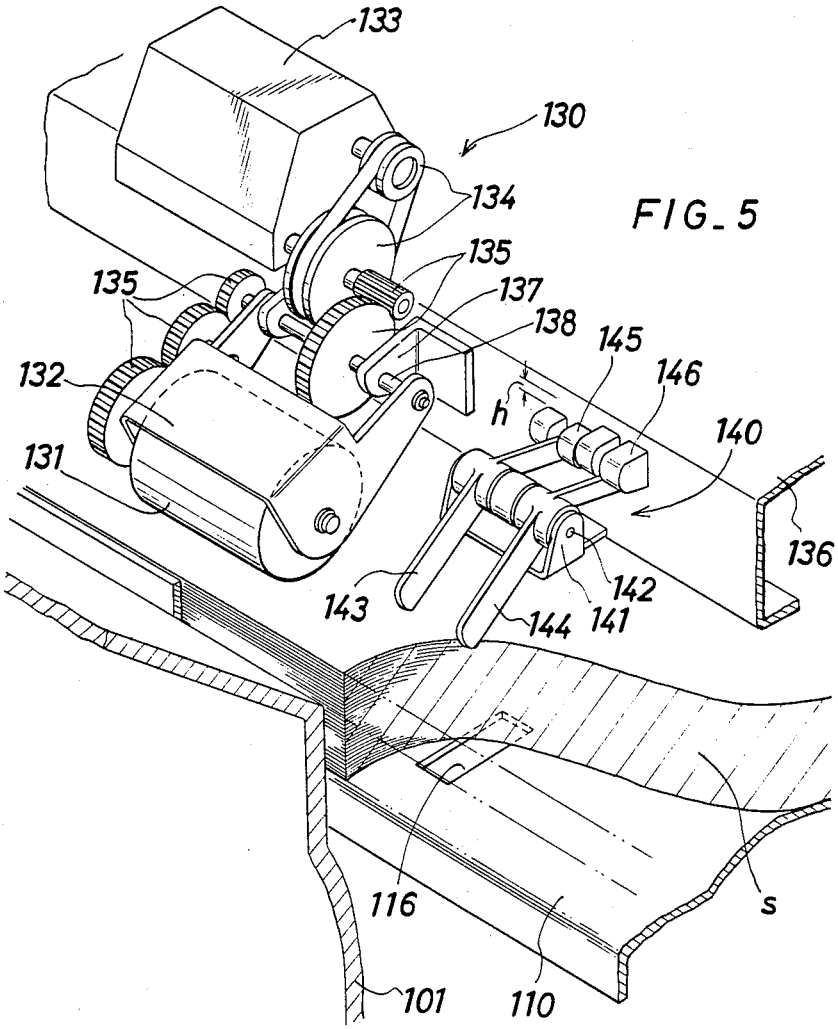
FIG. 5 is a perspective view schematically showing a sheet delivery means and a sheet detecting means.

As shown in FIG. 5, the sheet discharge means 130 provided within the sheet storage unit 100 comprises a sheet discharge roller 131 rotatably held by a roller holder 132 and a driving means including a power means 133 for driving the sheet discharge roller 131 through a transmission means such as a pair of belt wheels 134 and a plurality of gears 135. The holder 132 for the sheet discharge roller 131 is pivotally supported onto a mounting frame 136 by means of bearing members 137 and a pivot shaft 138. Though the roller holder 132 can therefore swing about the pivot shaft 138, it is restricted in its downward rotation in some degree so as not to be brought to the suspended state. However, the sheet discharge roller 131 comes into contact with the uppermost sheet of the stacked sheet s on the sheet tray 110 when the uppermost sheet comes near the highest position to which the sheet can possibly be elevated.

With this structure described above, the power means 133 is driven so as to give the rotating motion to the sheet discharge roller 131 via the belt wheels 134 and the gears 135, to thereby send the uppermost sheet of the stacked sheets out of the sheet storage unit 110. To prevent a plurality of sheets from being simultaneously sent out, there are provided corner pawls 105 inside the front corners of the sheet storage unit 100.

Denoted by 140 is a sheet detecting means disposed on the mounting frame 136 for detecting the level and existance of the stacked sheets s on the sheet tray 110. The sheet detecting means 140 is composed of a sheet level lever 143 and a sheet empty lever 144 both supported pivotally on supporting member 141 by means of a pivot shaft 142 as shown in FIG. 5. The levers 143 and 144 have their front ends brought into contact with the upper surface of the stacked sheets s on the sheet tray 110. There is formed an empty hole or recess 116 in the sheet tray 110 beneath the front end of the empty lever 143. On the portions of the mounting frame 136 opposite to the respective rear ends of the levers 143 and 144 there are disposed level and empty sensors 145 and 146 each having a photo coupler structure consisting of a light emitting element and a photoelectric detector, for example.

The level sensor 145 is so arranged that it is brought in the OFF state thereof by the rear end of the sheet level lever 143 intervening in the light path of the photo coupler used as the sensor 145 when the front end of the level lever 143 is out of contact with the sheets s stacked on the sheet tray 110, but otherwise, it assumes the ON state when the front end of the level lever 143 is in contact with the upper surface of the stacked sheets s to cause the rear end of the level lever 143 to be released from the level sensor 143.

The empty sensor 146 is placed higher in comparison with the level sensor 145 by the height of h. When the front end of the empty sensor 146 is out of contact with the stacked sheets s, the rear end of the empty lever 143 intervenes in the light path of the photo coupler used as the empty sensor 146, consequently to bring the sensor 146 in the OFF state, and otherwise, in the case of the front end of the same being in contact with the stacked sheets s, the emply sensor turns ON. Namely, when running out the sheets on the sheet tray, the front end of the empty lever 144 falls into the empty hole or recess 116 formed in the sheet tray 110 to thereby bring the empty sensor 146 in the OFF state even if the sheet tray comes to its own uppermost position.

With these sensors 145 and 146, the sheet tray 110 can be adequately determined in their position so as to place the uppermost sheet of the stacked sheets s on a level with the upper limited position thereof, and an alarm can be issued visually or acoustically when the stacked sheets are all spent. This is to say, while the height of the stacked sheets s are being reduced in the image forming operation, the level and empty levers 143 and 144 are gradually tilted downward, and then, when the uppermost sheet of the stacked sheets s reaches a predetermined level, the level sensor 145 positioned lower first turns OFF to thereby put the motor 128 of the elevating drive means 120 in motion, with the result that the sheet tray 110 is elevated. The stacked sheets s thus lifted comes in contact with the level lever 143 and causes the level sensor 145 to turn ON so as to stop the motor 128. Such working is reperatedly carried out during the image forming operation. Thereafter, when all the sheets are consumed, the empty lever 144 falls in the empty hole 116 bored in the sheet tray 110 reaching the upper limited position thereof, with the result that an empty alarm is issued.

In such a manner as described above, the stacked sheets s on the sheet tray 110 can keep its own adequate position during the image forming operation owing to the elevating drive means 120 and be continuously fed in time one by one out of the sheet storage unit 100 owing to the sheet delivery means 130.

The sheet thus discharged from the sheet storage unit 100 is introduced into the image forming unit 1 by means of the sheet delivery roller 6 disposed near the sheet intake port 5. In this embodiment, to further securely introduce the sheet into the unit 1, a sheet forwarding means 150 is disposed on the front portion of the sheet storage unit 100.

Figure 6:
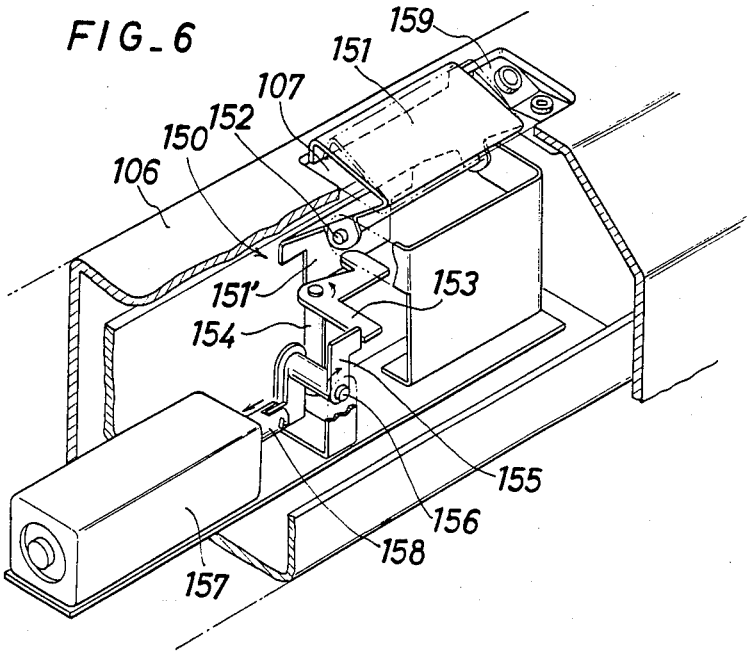
FIG. 6 is a perspective view schematically showing a sheet discharge means.

As shown in FIG. 6, the sheet forwarding means 150 is composed of a pressure member 151 which is disposed opposite to the sheet delivery roller 6 near the sheet intake port 5 of the image forming unit 1 and supported pivotally by a shaft 152 in the exposed state from an opening 107 formed in a sheet guide plate 106 defining a sheet discharge port of the sheet storage unit 100, push members 153 and 155 supported pivotally by a vertical shaft 154 and a horizontal shaft 156 respectively, and a solenoid means 157 having a plunger 158 coupled with the push member 155. A sheet sensor 159 is disposed in position beneath the sheet guide plate 106 in such a state of peeping through the opening 107 formed in the sheet guide plate 106. The sheet sensor 159 has a light emitting element for upwardly emitting a beam of light through the opening 107 and a photoelectric detector for receiving the light reflected from the sheet which will be sent out of the stacked sheets s on the sheet tray located on the right side in FIG. 6. Therefore, when the leading end portion of the sheet being fed from the stacked sheets reaches the opening 107, the beam of light from the light emitting element of the sheet sensor 159 impinges on and reflected from the leading end portion of the sheet traveling toward the image forming unit 1. The reflected light is incident upon the photoelectric detector of the sheet sensor 159, to thereby turn the sheet sensor into the ON state. As a result, the solenoid means 157 is electromagnetically energized so that the push levers 155 and 153 are actuated as indicated by the arrows in FIG. 6 to thereby urge the downward extending portion 151' of the pressure member 151, whereby the pressure member 151 is upward rotated around the shaft 152 so as to thrust the sheet placed thereon against the sheet delivery roller 6 disposed near the sheet intake port 5. Consequently, the sheet is brought into close contact with the sheet delivery roller 6 in motion and therefore, it can reliably be introduced into the image forming unit 1. Furthermore, while the sheet traveling into the image unit 1 goes past the opening 107, the sheet sensor 159 turns OFF and the sheet delivery means 130 assumes its standby state. In this state, when an image forming order is given, the sheet delivery means 130 and the sheet forwarding means 150 are again set in motion in the manner as described above.

Figure 7:
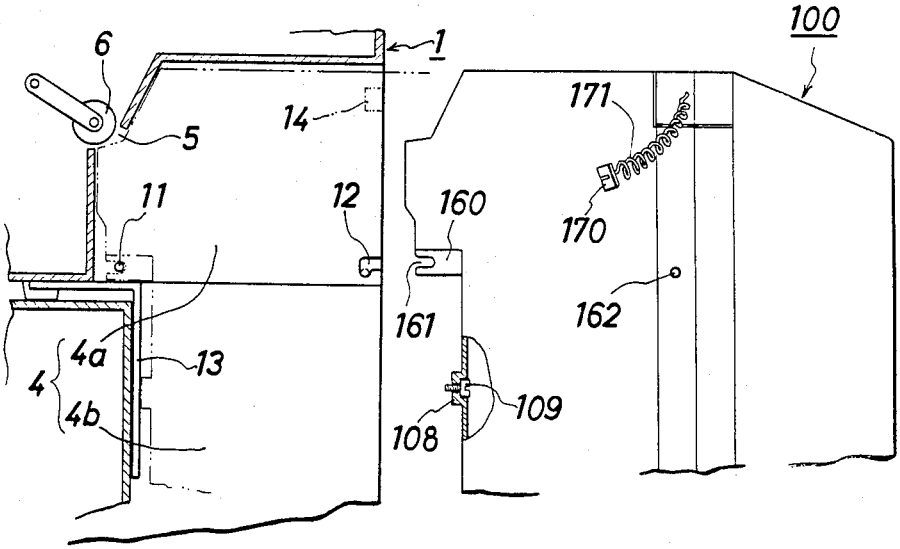
FIG. 7 is a schematic side view showing coupling means for the sheet storage unit.

Shown specifically in FIG. 7 is one example of a coupling means for securing the sheet storage unit 100 within the holder cavity 4 defined by the united image forming unit 1 and pedestal 10. A first coupling means in this embodiment is constituted by first coupling elements, namely, a pair of engaging pieces 160 attached to the front corner portions of the sheet storage unit 100 and each having a guide slot 161, and a pair of couterpart engaging pins 11 disposed on the respective cavity side walls defining the cavity half **4*a* of the image forming unit 1. A second coupling means is constituted by second coupling elements, namely, support pins 162 planted one on either side of the sheet storage unit 100, and substantially L-shaped guide grooves or slots 12 formed one in the respective cavity side walls defining the cavity half 4*a* of the image forming unit 1. It is desirable to locate the support pins 162 substantially at the intersection points of the side walls and the horizontal line passing through the center of gravity of the sheet storage unit 100**.

By bringing these coupling means in their engaged state at the time of putting the sheet storage unit 100 into the holder cavity 4 defined in the united image forming unit 1 and pedestal 10, the sheet storage unit 100 is securely held in position within the holder cavity 4, and then, can freely be detached from the image storage unit 100.

Moreover, the image forming unit 1 is provided with a fixing plate 13 extending downwardly along the innermost cavity wall of the cavity half **4*b* of the pedestal 10**.

On the other hand, the sheet storage unit 100 is provided on the front side thereof with at least one retaining member 108 which abuts on the fixing plate 13 when the sheet storage unit 100 is fitted into the holder cavity 4. By driving screws 109 into the fixing plate 13 through the retaining members 108, the sheet storage unit 100 can be secured within the holder cavity 4 defined in the united image forming unit 1 and pedestal 10. Of course, the sheet storage unit 100 thus secured can be detached from the holder cavity 4 by taking off the screws 109.

The sheet storage unit 100 is provided with an electric connector plug 170 capable of being fitted into a socket 14 of the image forming unit 1 so as to allow a sheet feeding command signal and an electric power from the image forming unit 1 to be given to the sheet storage unit 100. The electric connector plug 170 in this embodiment is connected with the sheet storage unit 100 by use of a flexible cord 171. Instead of such a connection means, the sheet storage unit 100 may be fixedly provided with one of mutually engaging connector members without use of an electrical cord or cable. In this case, the image forming unit 1 may have the counterpart connector member formed at the position confronting the socket fixed on the unit 100, so that the sheet storage unit 100 can readily establish electrical connection with the image forming unit 1 merely by putting the sheet storage unit 100 into the holder cavity 4.

Denoted by 173 is a manual switch disposed on the sheet storage unit 100. By operating the manual switch 173, the sheet tray 110 of the sheet storage unit 100 can be controlled to undergo vertical motion independent of the control of the image forming unit 1.

Figure 8:
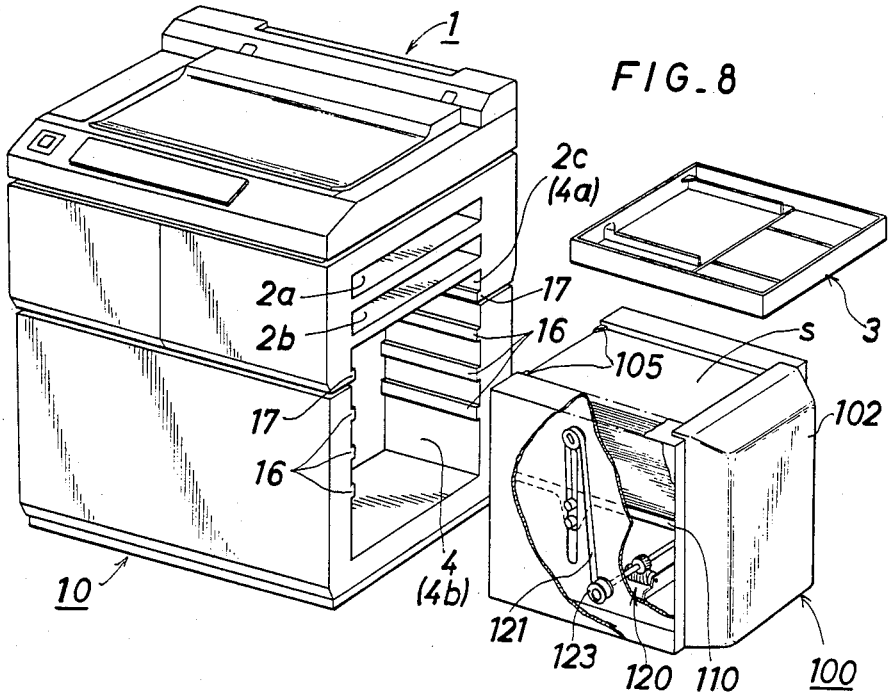
FIG. 8 is a partly broken away perspective view of another embodiment according to the present invention.
Figure 9:
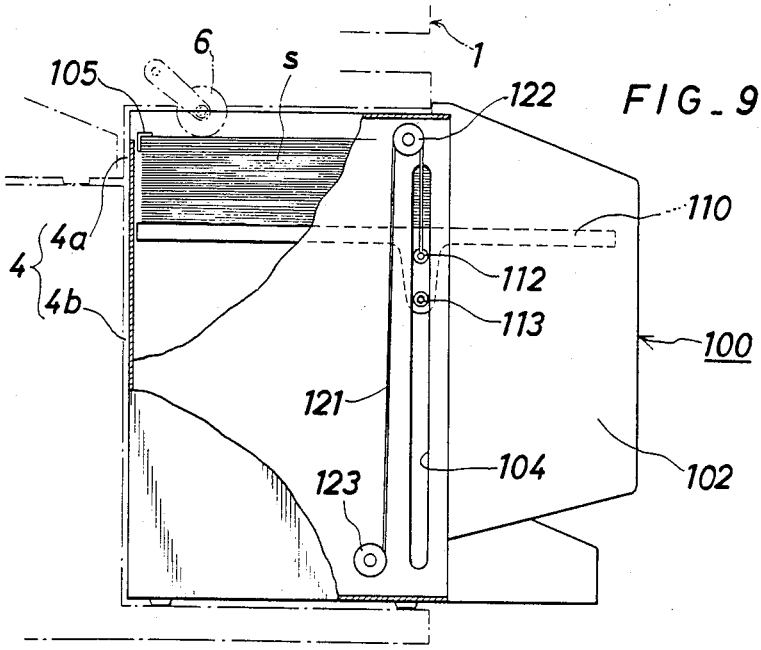
FIG. 9 is a partly broken away side view of a sheet storage unit of FIG. 8.

FIGS. 8 and 9 show a second embodiment according to the invention. Most elements of this embodiment have the same function as their counterparts in the first embodiment described earlier. These elements are assigned by the same reference numerals as those in the first embodiment and will not be described further here.

The second embodiment has a modified structure wherein the sheet storage unit 100 is open upward so that the sheet delivery roller 6 disposed above the holder cavity 4 comes in contact with the uppermost sheet of the stacked sheets s on the sheet tray 110 when the sheet storage unit 100 is put into the holder cavity 4. In the present embodiment, it is unnecessary for the sheet storage unit 100 to adopt such a sheet delivery means as designated by the reference numeral 130 in the first embodiment. The sheet detecting means 140 in the first embodiment may be disposed on the side of the sheet delivery roller 6 in the image forming unit 1.

When the sheet delivery roller 6 is set in motion following an image processing order given to the image forming unit 1, only one sheet is sent out of the stacked sheets s on the sheet tray 110 by the aid of the corner pawls 105.

On the opposite cavity side walls defining the cavity half **4*b* of the pedestal 10, at least one pair of guide steps 16 are formed for guiding the sheet storage unit 100 which is entering the holder cavity 4. The opposite guide steps 16 are adapted to hold the sheet cassette 3 out of use at the time the sheet storage unit 100 is detached from the holder cavity 4**.

Likewise, on the lower portions of the opposite cavity side walls defining the cavity half **4*a* in the image forming unit 1, there are formed guide steps 17 having a function of guiding the sheet storage unit 100 which is being put into the holder cavity 4. However, in the case where the sheet storage unit 100 is in the detached state from the holder cavity 4, the guide steps 17 are adapted to form a cassette holder 2*c* having the same function as the cassette holders 2*a* and 2*b*. Namely, when the sheet storage unit 100 is not used, three sheet cassettes 3 containing sheets of different sizes can simultaneously be fitted into the image forming unit 1 so that one sheet can be taken out of either sheet cassette. Thus the holder cavity 4 in this embodiment functions as a space for receiving either the sheet storage unit 100 or the sheet cassette 3**.

Because, as was mentioned earlier, the sheet storage unit 100 has the drive mechanism for elevating the stacked sheets s on the sheet tray 110 to a predetermined level so as to bring the uppermost sheet of the stacked sheets into contact with the sheet delivery roller 6, the sheets can be sent one by one of the sheet storage unit 100 into the image forming unit 1 without fail. In case where the sheet cassette 3 is used in the place of the sheet storage unit 100 and fitted into the cassette holder **2*c*, it is necessary to adopt a sheet lifting mechanism as shown in FIGS. 10(A) to 10**(C).

The sheet lifting mechanism comprises a first arm 200 pivotally supported by a pivot 201 fixed on the pedestal 10 and urged at the lower end thereof by a spring 202 so as to rotate clockwise around the pivot 210 as shown, and a second arm 210 pivotally supported by a pivot 211 fixed on the image forming unit 1 and urged at the upper end thereof by a spring 212. The first arm 200 is provided at the upper end thereof with a push-up roller 203 and has a recess 204 formed near the push-up roller 203. The second arm 210 is provided on the lower part thereof with a latch roller 214 which is caught in the recess 204 formed in the first arm 200 when the sheet storage unit 100 is in the detached state from the holder cavity 4 as shown in FIG. 10(A).

In this mechanism, the second arm 210 is thrust forwardly against the energizing force of the spring 212 by inserting the sheet cassette 3 into the cassette holder 2*c*, thereby causing the latch roller 214 to be released from the recess 204 formed in the first arm 200 and urging the first arm 200 to rotate clockwise about the pivot 211 as shown in FIG. 10(B). As a result, the bottom plate 3*a* on which the sheets s are stacked is thrust upwardly to bring the uppermost sheet of the stacked sheets s into contact with the sheet delivery roller 6.

On the other hand, in case where the sheet storage unit 100 is put into the holder cavity formed of the cavity halves 4*a* and 4*b*, the first and second arms 200 and 210 are thrust forwardly into the image forming unit 1 and the pedestal 10, and then, the stacked sheets s on the sheet tray 110 are set within the holder cavity so as to come in contact with sheet delivery roller 6 as shown in FIG. 10(C). In either way, the sheets can be sent out one by one by driving the sheet delivery roller 6 as has been explained in the foregoing.

As is plain from the foregoing description, according to the present invention, a sheet storage unit containing a large number of sheets such as copying papers can easily and reliably be coupled to and detached from an image forming unit such as a copying machine. This means that the sheets can easily be loaded into the sheet storage unit, and different sheet storage units can be used for one image processing device. Because the image forming unit and the pedestal according to the invention are formed with the holder cavity for deeply receiving the sheet storage unit, the sheet feeding distance, i.e. the sheet travel length in the image forming unit can be shortened, to thereby increase the speed of image processing operation, namely, attain elevation of the operation speed. Furthermore, since the sheet storage unit can readily be detached from the united image forming unit and pedestal, if the sheet introduced in the image forming unit should be jammed, the cause of trouble can easily be removed. Thus, it becomes easy to operate and maintain the system. Besides, the elevating drive means for moving up and down the sheet tray, the sheet delivery means and the sheet detecting means are synthetically controlled so as to adequately position the stacked sheets at a predetermined level, sheet delivery from the sheet storage unit to the image forming unit can steadily be carried out.

Obviously, many modifications and variations of the present invention are possible in light of the above teachings. It is therefore to be understood that within the scope of the appended claims, the present invention may be practiced otherwise than as specifically described herein.

What is claimed is:

1. A sheet feeding system for using in an image processing device having an image forming unit and a pedestal for permitting the image forming unit to be placed thereon, which comprises a sheet storage unit incorporating a sheet tray for permitting a large number of sheets to be stacked thereon and an elevating drive means for vertically moving said sheet tray so as to position the sheets stacked on said sheet tray to a fixed level, said image forming unit being provided in its lower side portion with an upper cavity half for receiving the upper portion of the sheet storage unit, and a sheet intake port formed in the innermost portion of the upper cavity half, and at least one sheet delivery roller disposed near said sheet intake port, said pedestal being provided in its upper side portion with a lower cavity half for receiving the lower portion of the sheet storage unit, which upper and lower cavity halves define a holder cavity for detachably receiving said sheet storage unit; and first and second coupling means for bringing the sheet storage unit into mutual engagement with the image forming unit, wherein said first coupling means comprises a pair of first coupling elements, one of the first coupling elements being located at the front portion of said sheet storage unit and the other first coupling element being located on the image forming unit at the portion opposite to said one first coupling element, and said second coupling means comprises two pairs of second coupling elements, one of each pair of the second coupling elements being located at either side wall portion of the sheet storage unit and the other of each pair of the second coupling elements being located on the image forming unit at the portion opposite to said one of each pair of second coupling elements.

2. A sheet feeding system according to claim 1, wherein said second coupling elements are located substantially at the intersection points of the side walls and a horizontal line passing through the center of gravity of said sheet storage unit.

3. A sheet feeding system according to claim 1, further comprising sheet detecting means mounted on said sheet storage unit and composed of a sheet level sensor for detecting the level of the sheets stacked on the sheet tray to thereby cause the sheets to be elevated to a fixed level when the sheets are lowered, and a sheet empty sensor for detecting the existence of the sheets stacked on the sheet tray to thereby allow an alarm to be issued when the sheets are removed.

* * * * *